United States Patent [19]

Swope et al.

[11] 4,422,592

[45] Dec. 27, 1983

[54] BRAKE MECHANISM FOR SPOOL

[75] Inventors: Jack G. Swope, St. Ignace; Harry C. Weiss, Moran, both of Mich.

[73] Assignee: Rennco Incorporated, Homer, Mich.

[21] Appl. No.: 338,810

[22] Filed: Jan. 11, 1982

[51] Int. Cl.[3] ..... B65H 25/28; B65H 25/22; B41J 33/52

[52] U.S. Cl. ..... 242/75.45; 101/27; 101/336; 242/156.2; 400/234

[58] Field of Search ..... 242/75.45, 75.43, 75.4, 242/156, 156.1, 156.2, 84.5 R, 84.5 A, 84.52 R, 84.52 A, 132; 101/27, 41, 292, 336; 400/219.3, 234, 236.2

[56] References Cited

U.S. PATENT DOCUMENTS

| | | | |
|---|---|---|---|
| 1,063,263 | 6/1913 | Howe | 242/75.45 |
| 1,822,495 | 9/1931 | Laycock | 242/75.45 |
| 1,859,577 | 5/1932 | Armbrecht | 242/75.43 |
| 1,925,580 | 9/1933 | Anderson | 242/75 |
| 1,992,706 | 2/1935 | Lira | 242/75.45 |
| 2,276,980 | 3/1942 | Jacobi | 242/75 |
| 2,733,876 | 2/1956 | Laycock | 242/75.43 |
| 3,128,692 | 4/1964 | Talarico | 101/27 X |
| 3,164,333 | 1/1965 | Robertson | 242/75.43 |
| 4,013,160 | 3/1977 | Colecchi et al. | 197/151 |
| 4,048,913 | 9/1977 | Navi | 101/27 |
| 4,313,376 | 2/1982 | Swope et al. | 101/27 |

FOREIGN PATENT DOCUMENTS

| | | | |
|---|---|---|---|
| 842328 | 5/1952 | Fed. Rep. of Germany | 242/75.45 |
| 885379 | 6/1953 | Fed. Rep. of Germany | 242/75.45 |
| 69735 | 3/1952 | Netherlands | 242/75.45 |

OTHER PUBLICATIONS

*Machine Design*, vol. 34, No. 8, p. 137, 3/29/62.

*Primary Examiner*—Stuart S. Levy
*Assistant Examiner*—Scott J. Haugland
*Attorney, Agent, or Firm*—Flynn, Thiel, Boutell & Tanis

[57] ABSTRACT

A brake mechanism for controlling a ribbon spool wherein a brake member is disposed in braking relationship with the spool for retarding rotation thereof. The brake member has a brake actuator projecting therefrom. An elongated follower pivotally bears against the spool to follow any decrease in the diameter thereof. The follower has an adjustment member which creates a cammed relationship with the brake actuator for progressively moving same and decreasing the brake torque as the follower pivotally moves in response to a decrease in spool diameter. This adjustment member is positioned to impose either a zero or a minimum torque on the brake member when the spool is empty. When in this empty-spool position, the adjustment member can be initially adjusted in a direction substantially parallel to the radial direction of the brake actuator so as to not affect this zero or minimum brake torque. However, this adjustment causes the adjustment member to swing about a different arc when the follower pivots due to being engaged with the full ribbon spool, whereby the movement imposed on the brake actuator is correspondingly changed so that the maximum brake torque for any selected spool diameter can be adjusted without affecting the zero or minimum torque for the empty-spool condition.

8 Claims, 7 Drawing Figures

BRAKE MECHANISM FOR SPOOL

FIELD OF THE INVENTION

This invention relates to an improved brake mechanism for controlling overrunning of a spool from which a ribbon or film is intermittently withdrawn, such as on an imprinter, and in particular relates to an improved adjustable brake mechanism which permits both the rate and range of braking torque as imposed on the spool to be adjusted so as to compensate for spools of different inertia while maintaining a substantially fixed zero or minimum brake torque when in an empty-spool condition.

BACKGROUND OF THE INVENTION

Copending application Ser. No. 129,435, now U.S. Pat. No. 4,313,376, filed on Mar. 11, 1980 and owned by the Assignee of this application, discloses an imprinter wherein a film or ribbon is intermittently withdrawn from a rotatable spool in accordance with the demand or usage of the ribbon. The imprinter has an adjustable brake device associated with the spool for imposing a braking torque thereon so as to prevent or control inertia-induced overrunning of the spool after the intermittent pulling-off of the ribbon has been terminated. This known braking mechanism employs a cam which coacts between a follower and a brake actuator so that the brake torque is a maximum at large spool diameters and progressively decreases as the spool becomes empty. While this brake mechanism has performed in a manner which is generally satisfactory, nevertheless it has been observed that the rate of brake torque decrease and the difference between the maximum and minimum brake torques always remains the same for the same spool diameter. While the initial or minimum brake torque (corresponding to the empty spool condition) can be initially adjusted in an attempt to compensate for ribbon spools of different inertia (such as spools of different axial length), nevertheless this adjustment affects only the initial or minimum torque since the rate or torque change and the range of torque (that is, the difference between the maximum and minimum torques) are not affected. In such circumstance, when the minimum or initial torque is increased so as to compensate for a heavy spool (that is, a spool of substantial axial length), then while this initial adjustment results in the maximum and minimum torques being both shifted upwardly, nevertheless the range or differential magnitude between these maximum and minimum torques still remains the same, as does the rate of torque change. Thus, under such circumstances, the brake torque imposed on the spool is not optimized since the adjustment must be such so as to thus result in substantially greater torque than desired when the spool approaches an empty condition (rather than the torque approaching zero as is desired for optimum operation) so that the proper performance is hence often seriously impaired. Since spools of the same diameter may have widely varying axial lengths, which different axial lengths may be of several orders of magnitude, and since the density of the film or ribbon itself may significantly vary without affecting the maximum spool diameter, these factors hence have a significant effect on the inertia and hence overrunning tendency of the spool. For this reason, the known brake mechanisms, one form of which is illustrated in the aforesaid copending application, have hence been unsuitable for use under such variable conditions since these known mechanisms have basically adjusted solely for changes in diameter.

Accordingly, this invention relates to an improved adjustable brake mechanism adapted for cooperation with a spool for imposing a braking torque thereon so as to prevent overrunning of the spool as the film or ribbon is pulled intermittently therefrom. The improved brake mechanism of this invention is hence intended to overcome the disadvantages associated with the known mechanisms, as explained above.

In the improved brake mechanism of this invention, the mechanism again includes structure which progressively decreases the braking torque on the spool as the outer diameter of the spool decreases due to withdrawal of ribbon or film. In addition, this improved brake mechanism incorporates adjustment structure therewith which changes both the rate of torque change and the range (that is, the differential between the maximum and minimum torques) without affecting the zero or minimum torque which exists under the empty spool condition. In this manner, the adjustment of the braking mechanism hence enables the braking torque to be suitably adjusted for use with numerous spools which, while of the same diameter, may be of substantially different inertia due to their being of different axial lengths or of different ribbon densities. In this manner, the braking torque imposed on the spool can hence be optimized so as to progressively decrease approximately linearly from the full-spool condition to the empty-spool condition, with the torque always approaching a very small minimum brake torque (which is preferably equal to or only slightly greater than zero) so as to thereby provide more uniform control over the pulling off of ribbon from the spool throughout the complete range between the full and empty conditions of the spool.

The improved brake mechanism includes a brake member disposed in braking relationship with the spool or its support shaft for retarding rotation thereof, which brake member has a brake actuator projecting therefrom. An elongated follower or sensor is pivotally supported on the frame and bears against the outer diameter of the spool so as to follow the decrease in the diameter thereof. This follower has an adjustment means thereon which creates a camming relationship with the brake actuator for progressively moving same and decreasing the brake torque as the follower pivotally moves in response to a decrease in the spool diameter. This adjustment means is positioned so as to effectively contact the brake actuator and impose either a zero or a minimum base torque on the brake member when the spool is empty. When in this empty-spool condition, the adjustment means can be initially adjusted in a direction substantially parallel to the radial direction of the brake actuator so as to not affect this zero or minimum brake torque. However, this change in the position of the adjustment means causes the latter to swing about a different arc when the follower pivots due to being engaged with the full ribbon spool, whereby the movement imposed on the brake actuator is correspondingly changed so that the maximum brake torque for any selected spool diameter can hence be adjusted without affecting the zero or minimum torque for the empty-spool condition. The rate of torque decrease is hence adjusted so as to provide optimum control as a function of the spool inertia.

Other objects and purposes of the invention will be apparent to persons familiar with devices of this type upon reading the following specification and inspecting the accompanying drawings.

DETAILED DESCRIPTION

Figure 1:
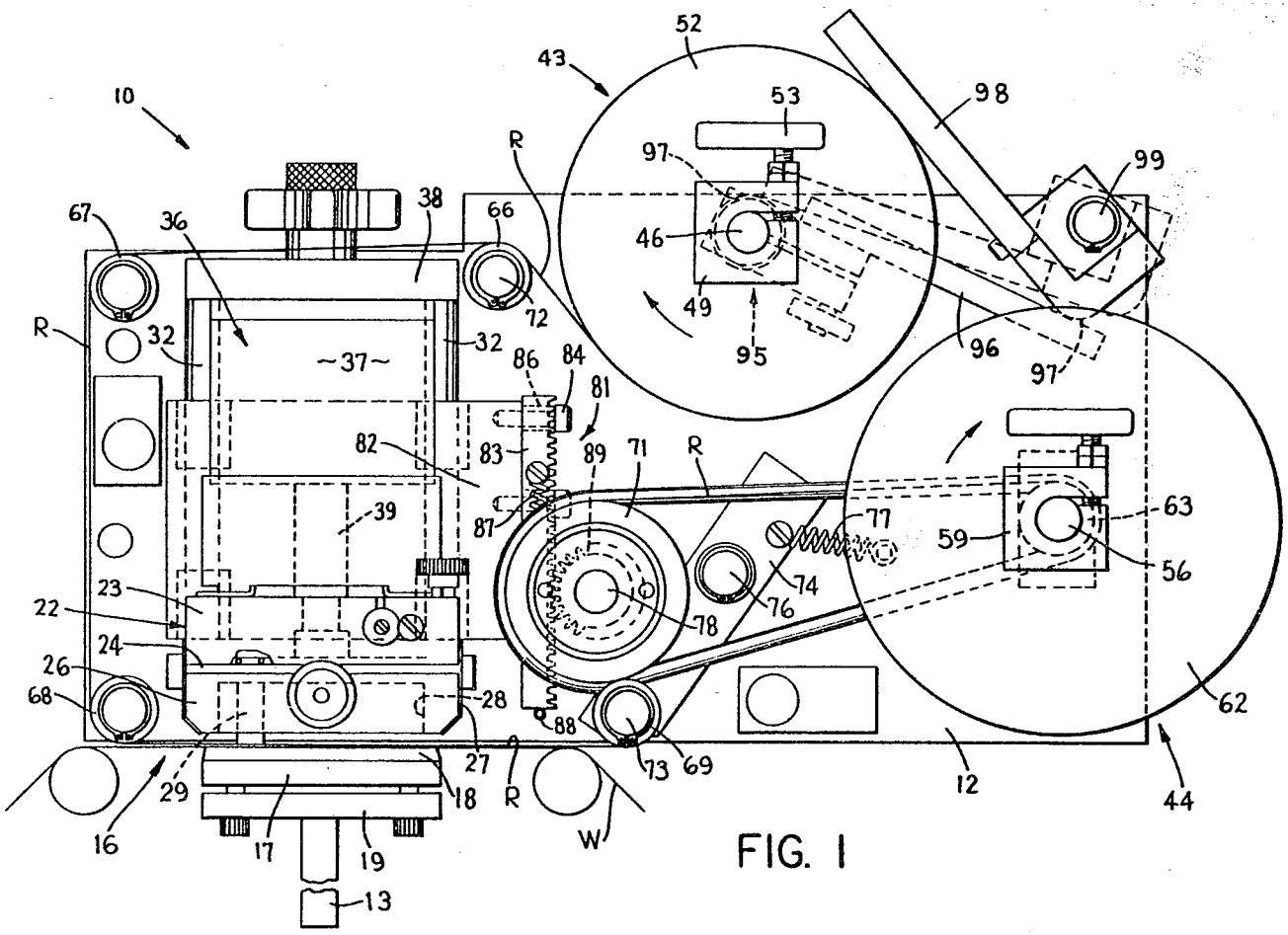
FIG. 1 is a front elevational view of the imprinter according to aforesaid application Ser. No. 129,435.

The improved brake mechanism of this invention is suitable for controlling overrunning of a spool from which a film, ribbon or web is intermittently withdrawn, including specifically the imprinter of aforementioned copending application Ser. No. 129,435, now U.S. Pat. No. 4,313,376. For this reason, the disclosure of said application Ser. No. 129,435 is, in its entirety, incorporated herein by reference. Further, to facilitate the description of the improved brake mechanism and its relationship to the imprinter, the imprinter from said copending application will be briefly described with reference to FIGS. 1 and 2.

The imprinter 10 includes a stationary support frame 11 for enabling the imprinter to be mounted directly on, or in close association with, a conventional packaging machine. This support frame 11, in the illustrated embodiment, includes a vertically projecting frame plate 12. A frame bracket 13 projects outwardly below the plate 12.

The imprinter 10 has an imprint assembly 16 associated therewith. This assembly includes a stationary pressing head or platen 17 having a deformable pad 18, on the upper surface thereof for supporting the printing ribbon R and packaging web W. The platen 17 is adjustably supported on a mounting plate 19 which is fixedly secured to the bracket 13.

Imprint assembly 16 also includes a vertically reciprocal print head assembly 22. The latter includes a print head 23 having an electrical heater retainer plate 24 secured to the lower part thereof. A type holder 26 is positioned below the heater retainer plate, and is stationarily supported on the print head 23 by retainers 27. The type holder 26 has a downwardly-opening recess 28 which supports therein a plurality of interchangeable type elements 29, the type surfaces or characters of which face downwardly opposite the lower platen.

The print head assembly 22 is vertically slidable toward and away from the stationary platen 17. For this purpose, the print head 23 has a pair of parallel sleeve-like guides fixed to one side thereof, which guides are vertically slidably supported on vertically extending guide rods 32 which are stationarily supported with respect to the frame plate 12.

The print head assembly 22 is vertically linearly moved by a motor or drive device 36, the latter preferably comprising a double-acting fluid pressure cylinder of substantially conventional construction. This fluid pressure cylinder 36 has the housing 37 thereof secured to a mounting plate 38 which is stationarily supported from the frame plate 12. The reciprocal piston rod 39 of the cylinder 36 projects vertically downwardly and has the lower free end thereof joined to the print head 23 so as to control the vertical reciprocal movement of the print head assembly 22.

The imprinter 10 also has ribbon supply and take-up assemblies 43 and 44, respectively, associated therewith. These assemblies are individually described hereinafter.

Considering first the ribbon supply assembly 43, same includes an elongated rotatable support shaft 46 which projects horizontally from the frame plate 12 in a cantilevered manner and is rotatably supported by a conventional bearing block 47. A pair of axially spaced spool hubs 48 and 49 are nonrotatably supported on the shaft 46. These spool hubs 48 and 49 engage the opposite axial ends of the hub or core 51 of a conventional ribbon spool 52 so as to nonrotatably support the ribbon spool on the shaft 46. The outer spool hub 49 is removable from the shaft to enable the ribbon spools to be interchanged, and for this purpose is formed as a split block having a locking screw 53 associated therewith.

The ribbon spool 52 may be of any desired width dependent upon the type of imprinting operation desired. Further, as is well understood, the spool 52 comprises a spirally wound film or ribbon R of any conventional construction.

The ribbon take-up assembly 44 is of generally similar construction, and includes a rotatable support shaft 56 which projects horizontally in a cantilevered fashion from the frame plate 12, being supported thereon by a bearing block 57. This shaft 56 extends parallel with, but is positioned below and sidewardly from, the shaft 46. Support hubs 58 and 59 are nonrotatably mounted on the support shaft 56, with the outer hub 59 being removable to enable the spool of used ribbon to be removed. These hubs 58–59 engage the opposite axial ends of an empty spool core 61 to hold same nonrotatable with respect to the shaft 56 so that the used ribbon R can be wound therearound. Support hubs 58–59 preferably have annular end plates 62 associated therewith for confining the wound-up ribbon therebetween. The rotation of the ribbon take-up assembly 44 is controlled by a driven pulley 63 which is nonrotatably secured to the shaft 56.

The imprinter also provides a system of guide rollers which suitably guide and displace the ribbon R along a desired path. A first guide roller deflects the withdrawn ribbon R so that it passes horizontally over the upper end of the pressure cylinder 36, whereupon the ribbon is deflected downwardly by a second guide roller 67. A third guide roller 68 causes the ribbon R to be deflected horizontally so as to pass over the lower platen 17. A further guide roller 69 has the ribbon R wrapped approximately one-half revolution therearound, from which the ribbon then passes around a drive roller 71 secured to a drive shaft 78, and from there the ribbon R extends to the take-up core or spool 61.

The guide rollers 66–69 are all disposed for rotation about substantially parallel, horizontal axes. Each of the guide rollers 66–68 is suitably rotatably supported on a horizontally projecting shaft, such as shaft 72 associated with roller 66, which shaft is fixed to and projects outwardly from the frame plate 12.

The guide roller 69, on the other hand, is rotatably supported on a horizontally projecting shaft 73 which, while it extends parallel with the shaft 72, is fixedly mounted to and projects outwardly from one end of a lever or pivot arm 74. This arm 74 is pivotally displaceable about the pivot shaft 76 which is fixed to and projects horizontally from the frame plate 12 in parallel relationship to the shafts 72 and 73. A tension spring 77 continually urges the lever 74 in a clockwise direction as illustrated in FIG. 1, thereby continuously urging the guide roller 69 against the periphery of the drive roller 71 to insure that the ribbon R is grippingly engaged between these rollers.

The rotational driving of the drive roller 71, which effects an intermittent, stepwise, unidirectional advancing of the ribbon R, is controlled by a primary motion-transfer mechanism 81 which itself is driven from the fluid pressure cylinder 36 so that the unidirectional intermittent advancing of the ribbon is synchronized with the imprinting operation.

The motion-transfer mechanism 81 includes means for converting the reciprocal linear movement of the fluid pressure cylinder 36 into intermittent unidirectional rotation of the drive roller 71. This mechanism 81 also includes suitable lost motion during the linear-to-rotary conversion so that the rotational driving of roller 71 occurs through only a portion of the linear stroke.

Figure 2:
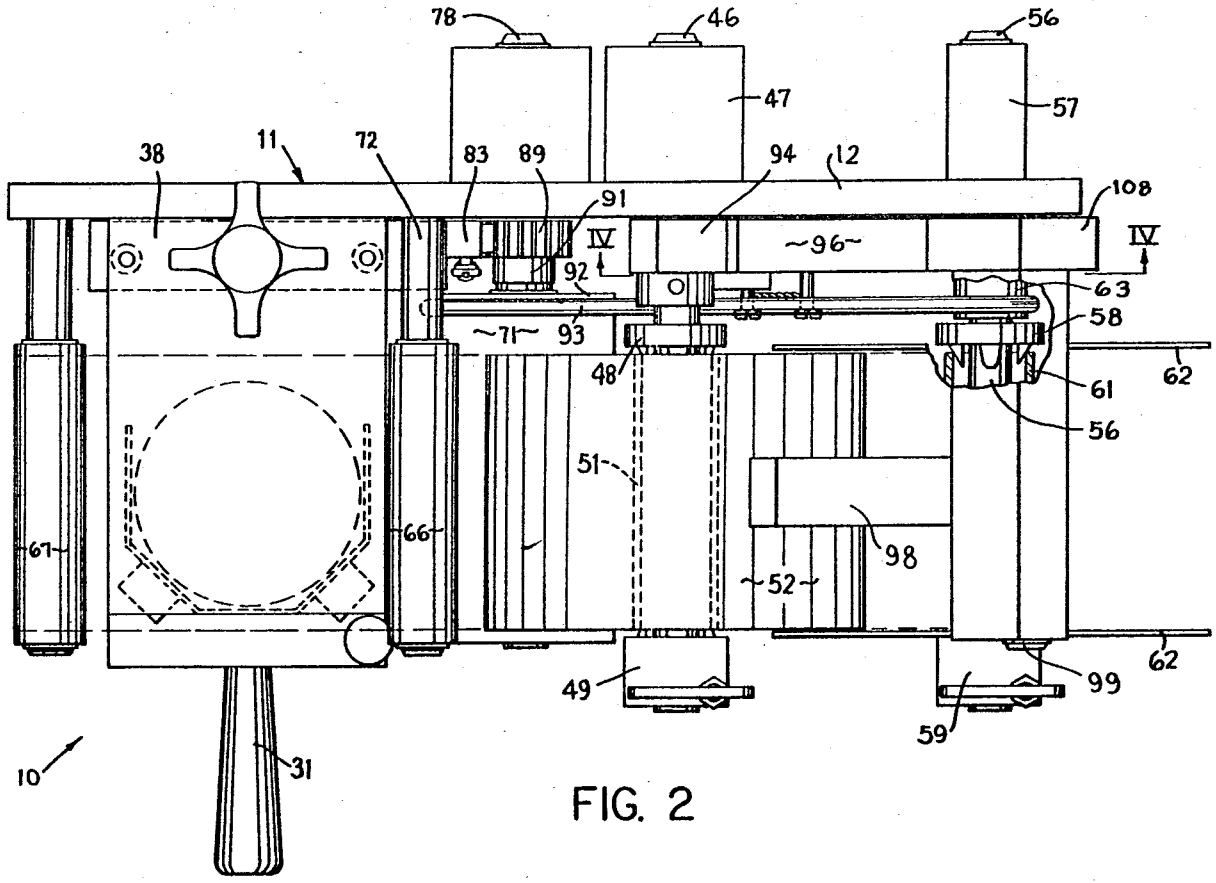
FIG. 2 is a top view of the imprinter shown in FIG. 1.

As illustrated in FIGS. 1 and 2, the linear-to-rotary motion conversion is effected by a gear-and-rack assembly. For this purpose, the print head 23 has a bracket 82 fixed thereto, which bracket supports a vertically elongated gear rack 83. The gear rack 83 extends vertically in parallel relationship with the direction of movement of the printing head. The gear rack 83 is connected to bracket 82 by a pair of mounting screws 84 which extend through vertically elongated slots 86 formed in the gear rack. These elongated slots 86 permit limited vertical displacement of gear rack 83 relative to bracket 82, and hence create a lost-motion connection therebetween. A tension spring 87 always resiliently urges the gear rack 83 downwardly toward its lowermost position, in which position the screws 84 abut the upper ends of the elongated slots 86. However, when the print head assembly 22 approaches its lowermost position, then the lower end of gear rack 83 abuts against a stationary stop pin 88 which prevents further downward displacement of the gear rack 83 so that, when the print head assembly 22 and bracket 82 continue their downward movement, the gear rack 83 is displaced upwardly relative thereto against the urging of spring 87. This relative displacement of rack 83 against the urging of spring 87 is limited to a small distance, such as in the order of 1/16 inch.

The gear rack 83 is disposed in continuous meshing engagement with a rotatable gear 89, the latter being coaxial with but freely rotatably supported relative to the drive shaft 78. The gear 89 is drivingly connected to the drive shaft 78 through a conventional one-way clutch 91 to effect rotation of the shaft 78, and of the drive roller 71, only when the gear is being rotated (clockwise in FIG. 1) during the retraction (that is, upward) movement of the print head assembly 22.

The motion-transfer mechanism 81 also includes secondary motion-transfer means for causing intermittent unidirectional rotation of the take-up spool assembly 44. For this purpose, the drive roller 71 has a large diameter driving pulley 92 fixedly associated therewith. An endless drive belt 93 extends between and is engaged with the driving and driven pulleys 92 and 63, respectively, to effect the desired intermittent rotation of the take-up spool 44.

To prevent overrunning of the spool, the imprinter has a brake mechanism 95 associated with the supply spool 52, which brake mechanism senses the diameter of the supply spool and automatically varies the braking torque applied to the supply spool to prevent overrun thereof irrespective of the spool diameter. This braking mechanism 95 includes a split, nylon brake block 94 which snugly surrounds the spool support shaft 46. This brake block 94 has an elongated extension or lever 96 projecting outwardly therefrom. The outer end of brake lever 96 bears against an outer arcuate cam surface 97 formed on a follower 98, the latter being freely rotatably supported on a shaft 99 which projects horizontally from the guide plate 13 in parallel relationship to the ribbon guide shaft. The cam surface 107 is of progressively changing radius. The follower 98, adjacent the free end thereof, bears against the surface of the ribbon spool 52 and hence senses the diameter of the spool at all times.

The structure and operation of the imprinter 10 is described in greater detail in said copending application Ser. No. 129,435, whereby further description of this known structure is hence believed unnecessary.

Since the aforementioned brake mechanism 95 does not permit the range (that is, the differential between the maximum and minimum torques) and rate of brake torque to be adjusted in dependence on the inertia of the spool, the present invention hence relates to an improved brake mechanism which hence eliminates these shortcomings, which improved brake mechanism is designed so as to be substituted for the aforementioned brake mechanism 95 for incorporation into the imprinter 10. This improved brake mechanism is described hereinafter with reference to FIGS. 3–7.

Figure 3:
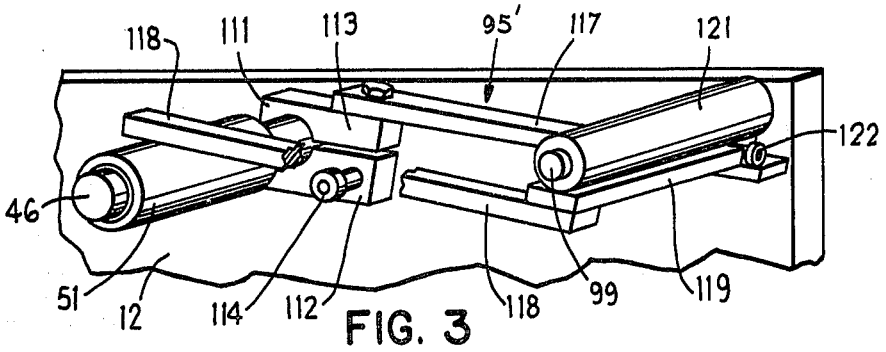
FIG. 3 is a fragmentary perspective view illustrating the improved brake mechanism of this invention, which brake mechanism is particularly suitable for use on the imprinter of FIGS. 1 and 2.
Figure 4:
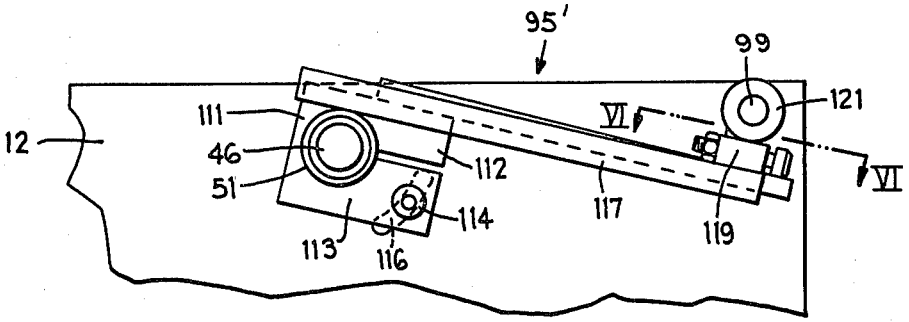
FIG. 4 is a fragmentary elevational view showing the improved brake mechanism in its zero or minimum torque condition, namely the empty-spool condition.
Figure 5:
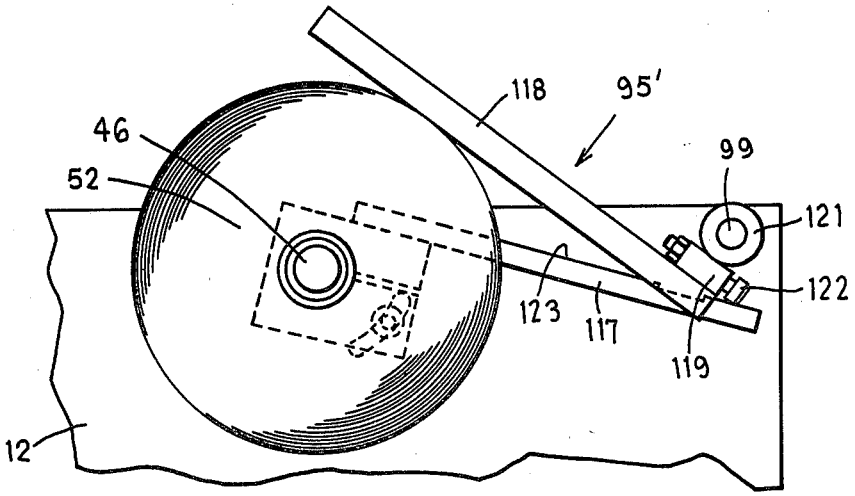
FIG. 5 is a fragmentary elevational view similar to FIG. 4 but showing the brake mechanism in association with a full spool.
Figure 6:
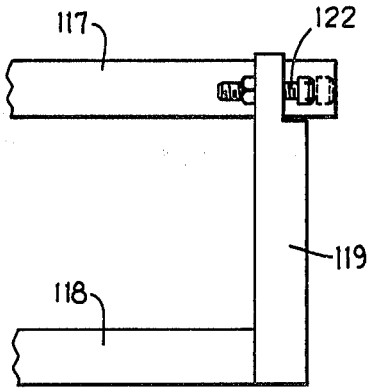
FIG. 6 is a fragmentary view taken substantially along line VI—VI in FIG. 4.

The improved brake mechanism 95' of this invention, as illustrated by FIGS. 3–5, includes a blocklike brake member 111 formed of nylon or similar synthetic material, which brake member 111 has an opening therethrough so that the brake member snugly surrounds the spool support shaft 46. The brake member 111 has a slit or split which extends from the periphery thereof into the central opening, whereby the brake member has a pair of opposed arms 112 and 113. A suitable locking screw 114 extends through the lower arm 113, which screw in turn projects through a slot or oversized hole 116 formed in the frame plate 12 for permitting the angular position of the brake member to be suitably adjusted. The locking screw 114 has lock nuts thereon disposed on opposite sides of the frame plate 12 for fixedly securing the brake member in the desired position. The upper brake arm 112 has an elongated extension or actuating lever 117 fixed thereto and projecting outwardly therefrom in a direction which is approximately radial with respect to the support shaft 46.

The position of the brake actuator lever 117 is controlled by an elongated follower 118 which senses and responds to any decrease in the diameter of the ribbon spool 52. This follower 118 comprises an elongate lever which has one end thereof fixedly secured to a support bar 119, the latter in turn being fixed to a support sleeve 121 which is rotatably supported on the shaft 99. This thus mounts the follower 118 for pivotal movement so that the free end portion of follower 118 rests against the outer diameter of spool 52, whereupon the weight of the follower swings same downwardly in response to a decrease in the spool diameter.

To angularly displace the brake lever 117 in response to pivoting of the follower 118, the latter movably mounts thereon an adjusting member 122 which also effectively functions as a cam for creating a cammed engagement with the upper surface 123 of the brake actuator lever 117. The adjusting member 122 comprises an elongated threaded screw which extends through the support bar 119, which screw 122 is positioned directly over the upper surface 123 of follower 118. The longitudinal axis of screw 122 extends so that, when the follower 118 is in its lower position wherein it is in contact with the hub of an empty brake spool as diagrammatically illustrated in FIG. 4, then the longitudinal axis of the screw 122 extends parallel to the upper surface 123 of the brake lever 117, and at the same time the axis of screw 122 extends perpendicular to but in nonintersecting relationship with the axes of the shafts 46 and 99. Further, the axis of screw 122 extends substantially in the longitudinal or elongated direction of the follower 118.

Figure 7:
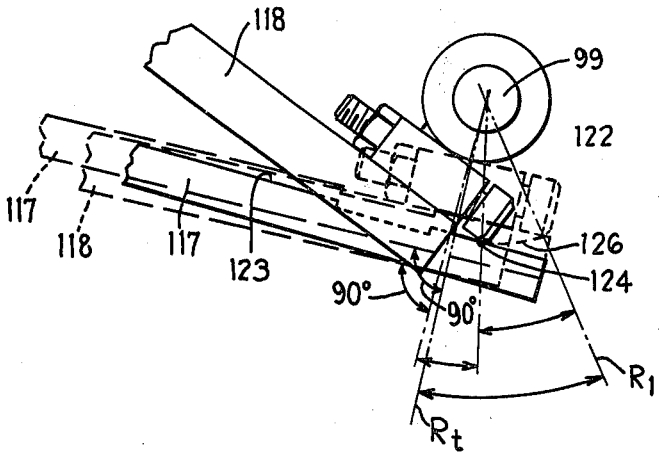
FIG. 7 is an enlarged, fragmentary view which diagramatically illustrates the cooperative relationship of parts of the improved brake mechanism.

As illustrated in FIG. 4, and as also illustrated by dotted lines in FIG. 7, the screw or adjusting member 122 is disposed so that, when the follower is in engagement with the empty spool hub, the head of screw 122 is positioned so as to just contact the upper surface 123 of brake lever 117. This is accomplished by initially adjustably positioning the brake member 111 so that the lever 117 just contacts the head of screw 122, with the arms 112 and 113 of the brake block being compressed just sufficiently so as to effectively create a snug relationship between the brake block and the shaft, following which the screw 114 is tightened to lock the brake block in position relative to the frame plate 12. In this manner, when in the empty-spool position, the brake block exerts either zero torque, or at least an extremely small torque which closely approaches zero.

In addition, when in the empty-spool position indicated by dotted lines in FIG. 7, the point of contact 124 between the screw head and the surface 123 is disposed on a radial plane $R_1$ which is angularly spaced a substantial angular extent from the radial plane $R_t$ which extends perpendicular to the surface 123. This angular displacement of plane $R_1$ from perpendicular plane $R_t$ is normally at least 30° since the arcuate displacement of follower 118 in moving between a full-spool position and an empty-spool position is normally in the range of 20°–25°. This thus permits the contact point 124 to swing through this angle of about 25° into the solid line position indicated in FIG. 7 without passing into or through a dead-center position defined by the plane $R_t$.

As indicated by FIG. 7, when a full spool is mounted on the apparatus, lever 118 is in the position indicated by solid lines, whereupon the brake lever 117 is hence angularly deflected downwardly into the solid line position of FIG. 7. The upper brake arm 112 is thus compressed downwardly toward the lower arm 113, whereupon the brake member 111 exerts an increased braking torque on the shaft 46 so as to prevent overrunning thereof when the spool diameter is large. However, as the spool diameter decreases, the follower 118 swings downwardly, causing the contact point 124 to move along the arcuate path 126 illustrated in FIG. 7 until, upon emptying of the spool, the contact point returns to the dotted line position of FIG. 7. Hence, during this decrease in the spool diameter, the brake lever 117 will progressively move upwardly so as to remain in contact with the adjusting screw 122 until the lever 117 reaches the dotted line position, at which point a minimal or zero torque is imposed on the shaft 46. The brake lever 117 follows the above-described movement of the adjusting screw 122 due to the fact that the brake member 111 is elastically compressed when the follower 118 is swung away from the empty-spool position, whereupon this compression hence continuously resiliently urges the brake lever 117 into contact with the adjusting screw 122.

When a ribbon spool of substantially greater inertia is mounted on the shaft 46, such as a spool having the same outer diameter but having an axial length of substantially increased magnitude, then an increase in the maximum brake torque is desired in order to control the increased inertia of this spool. In this situation, the adjusting screw 122 can then be threaded outwardly (rightwardly in FIGS. 6 and 7) so that the head thereof and its point of contact 124 with the surface 123 is moved further away from the radial plane $R_t$, and hence is also displaced a greater radial distance from the axis of shaft 99. In this manner, even though the point of contact 124 still swings through the same angle between the spool-empty and spool-full positions, nevertheless the magnitude of displacement of the contact point 124 is now increased, and hence the angular displacement of the brake lever 117 when in the spool-full position is similarly increased so that the maximum brake torque is likewise increased. This increased brake torque, however, still decreases progressively as the spool diameter decreases, but at a different rate inasmuch as the minimum torque still equals or closely approaches zero when the follower 118 approaches the spool-empty position.

Hence, the improved brake mechanism 95' of this invention thus permits the maximum brake torque applied to the spool to be initially adjusted according to the spool inertia, even though the spool may be of the same diameter, but no matter how much brake torque is applied when the spool is full, nevertheless the brake torque always progressively decreases and approaches zero when the spool follower reaches the empty core. Thus, this improved mechanism permits both the rate and range of brake torque to be selectively varied. At the same time, this mechanism is of simple structure, is durable in operation, and is simple to adjust, and yet is able to accomplish this desirable function without requiring specially shaped or complex cam mechanisms and the like.

While the improved brake mechanism has been described above in relationship to its incorporation into an imprinter, it will be appreciated that this braking mechanism is also suitable for use on numerous other machines which support a spool of thin ribbon, film or the like, which ribbon is intermittently withdrawn.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an imprinting apparatus using a ribbon for permitting imprinting of data, said apparatus including a frame, spool-supporting shaft means rotatably supported on the frame and mounting thereon a spool of said ribbon, guide means for movably guiding the ribbon in a preselected path as the ribbon is withdrawn from the spool, imprint means associated with a selected part of the ribbon path, driving means disposed in driving engagement with said ribbon for effecting intermittent and unidirectional displacement of said ribbon along said path and withdrawal of said ribbon from said spool, and brake means associated with said spool for imposing a braking torque thereon for regulating the tension of the ribbon withdrawn therefrom and for preventing overrunning of the spool, said brake means including an elongated follower pivotally supported on said frame and having a part thereof urged into engagement with the outer diameter of the spool for sensing the diameter of said spool and for sensing any decrease in said diameter as the ribbon is withdrawn, said brake means also including a brake member associated with said spool for imposing a braking torque thereon, said brake member having an elongated brake actuating arm associated therewith and projecting therefrom for permitting the braking torque to be varied in response to movement of said actuating arm, and said follower having a cam associated therewith and disposed in contact with said brake actuating arm for transmitting the pivotal movement of said follower to said brake actuating arm so that the braking torque imposed by the brake member on the spool decreases in response to a decrease in the spool diameter, comprising the improvement wherein the brake means includes adjusting means mounted on said follower and including said cam for permitting the rate of brake torque change to be selectively adjusted per unit change in spool diameter without significantly changing or affecting the brake torque imposed on the spool when empty, said brake actuating arm extending approximately radially outwardly from the rotational axis of said spool and defining thereon a substantially planar contact surface which is contacted by said cam, and said adjusting means including mounting means movably supporting said cam on said follower for permitting the initial position of said cam to be adjusted relative to said follower, said mounting means permitting said cam to be movably adjusted along a direction which extends substantially parallel to said contact surface when the follower is in engagement with an empty spool so that the adjustment does not significantly affect the position of said brake actuating arm.

2. An apparatus according to claim 1, wherein said cam is positioned in radially spaced relationship from the pivot axis of said follower and is swingable through an arc generated about said pivot axis when said follower is angularly displaced due to withdrawal of ribbon from said spool, said cam having a part thereof which creates a point of contact with the contact surface on said brake actuating arm, said part being positioned so that the contact point swings through an arc which is located entirely on one side of a plane which extends radially from said pivot axis and is perpendicular to said contact surface.

3. An apparatus according to claim 1 or claim 2, wherein said cam comprises an elongated screwlike member which is threadably supported on said follower, said screwlike member having an enlarged head portion which contacts the contact surface on said brake actuating arm.

4. An apparatus according to claim 1, wherein said brake member comprises a blocklike member having an opening therethrough for accommodating therein the spool-supporting shaft means, the brake member having a slit which extends radially thereof from said opening to the external periphery thereof so that the brake member defines a pair of opposed leg portions disposed on opposite sides of said slit, one of said leg portions being fixed with respect to the frame, the other leg portion being resiliently deflectable toward said fixed leg portion so as to increase the clamping of the brake member relative to the shaft means to thereby cause a corresponding increase in the braking torque, said brake actuating arm being fixed to said other leg portion and projecting outwardly therefrom in a direction which is approximately radial with respect to the rotational axis of the spool-supporting shaft means, said brake actuating arm adjacent the outer end thereof defining thereon said planar contact surface which also extends approximately in said radial direction, said follower being supported for pivotal movement on said frame about a pivot axis which is approximately parallel to but sidewardly spaced from the rotational axis of said spool-supporting shaft means, said follower being elongated and projecting outwardly from said pivot axis so that the follower defines a free end portion which bears against the outer diameter of the ribbon spool, said cam being mounted on said follower in the vicinity of but radially spaced from said pivot axis, said cam being maintained in bearing engagement with the contact surface on said brake actuating arm for tending to deflect said other leg portion toward said one leg portion, and said mounting means permitting the position of said cam to be selectively adjusted relative to said follower about said pivot axis.

5. In an apparatus using a ribbon, said apparatus including a frame, spool-supporting shaft means supported on the frame and mounting thereon a spool of said ribbon, driving means disposed in driving engagement with said ribbon for effecting intermittent and unidirectional withdrawal of said ribbon from said spool, and brake means associated with said spool for imposing a braking torque thereon for regulating the tension of the ribbon withdrawn therefrom and for preventing overrunning of the spool, said brake means including an elongated follower pivotally supported on said frame and having a part thereof urged into engagement with the outer diameter of the spool for sensing the diameter of said spool and for sensing any decrease in said diameter as the ribbon is withdrawn, said brake means also including a brake member associated with said spool for imposing a braking torque thereon, said brake member having an elongated brake actuating arm associated therewith and projecting therefrom for permitting the braking torque to be varied in response to movement of said actuating arm, and said follower having a cam associated therewith and disposed in contact with said brake actuating arm for transmitting the pivotal movement of said follower to said brake actuating arm so that the braking torque imposed by the brake member on the spool decreases in response to a decrease in the spool diameter, comprising the improvement wherein the brake means includes adjusting means mounted on said follower and including said cam for permitting the rate of brake torque change to be selectively adjusted per unit change in spool diameter without significantly changing or affecting the brake torque imposed on the spool when empty, said brake actuating arm including thereon a contact surface which is adapted to be contacted by said cam, said adjusting means including mounting structure for movably supporting said cam on said follower for permitting the position of said cam to be movably displaced on said follower in a direction which is substantially parallel to said surface when said brake means is in a position corresponding to an empty spool so that the adjustment will not significantly affect the initial brake torque between the spool and the brake member when the latter is in the empty-spool position, and said cam comprising an elongated screwlike member which is threadably supported on said follower, said screwlike member having a head portion which contacts the contact surface on said brake actuating arm.

6. An apparatus according to claim 5, wherein said follower comprises an elongated lever which is pivotally supported adjacent one end thereof for swinging movement about a pivot axis which is radially spaced from but extends substantially parallel with the rotational axis of said spool, said lever being elongated within a plane which is perpendicular to said pivot axis so that said lever in the vicinity of the other end thereof will contact the outer diameter of the spool, said screwlike member being threadably mounted on said lever adjacent said one end thereof in radially spaced relationship from said pivot axis so that said screwlike member can be movably displaced relative to said lever within a plane which perpendicularly intersects said pivot axis for adjustably displacing the head of the screwlike member angularly about said pivot axis.

7. An apparatus according to claim 6, wherein said screwlike member extends substantially in the longitudinal direction of said lever and is adjustably movable relative to said lever in said longitudinal direction.

8. An apparatus according to claim 7, wherein said actuating arm projects approximately radially outwardly away from the shaft means in a direction generally toward said pivot axis, said follower lever and said actuating arm being substantially parallel with one another when in their respective positions corresponding to an empty spool, the head portion of said screwlike member being disposed for contacting the actuating arm at a location disposed adjacent the free end thereof, and said head portion being spaced outwardly from one side of an axial plane which passes through said pivot axis and extends substantially perpendicular to the longitudinal direction of said follower lever, said shaft means being disposed on the opposite side of said axial plane.

* * * * *